US005560550A

United States Patent [19]

Krawczyk

[11] Patent Number: 5,560,550

[45] Date of Patent: Oct. 1, 1996

[54] DRY SOLIDS PUMP SYSTEM FOR FEEDING A HIGH PRESSURE COMBUSTOR

[75] Inventor: Paul D. Krawczyk, Westfield, Mass.

[73] Assignee: Combustion Engineering, Inc., Windsor, Conn.

[21] Appl. No.: 362,800

[22] Filed: Dec. 22, 1994

[51] Int. Cl.[6] ..... B02C 19/12; B02C 23/18

[52] U.S. Cl. ..... 241/19; 241/24.31; 241/600

[58] Field of Search ..... 241/19, 24, 600, 241/79.1, 24.31

[56] References Cited

U.S. PATENT DOCUMENTS

| | | | |
|---|---|---|---|
| 2,916,217 | 12/1959 | Yellott | 241/600 X |
| 4,036,564 | 7/1977 | Richards | 417/344 |
| 4,067,666 | 1/1978 | Richards | 417/265 |
| 4,164,124 | 8/1979 | Taylor et al. | 60/683 |
| 4,244,528 | 1/1981 | Vlnaty | 241/5 |
| 4,335,733 | 6/1982 | Richards | 137/1 |
| 5,048,761 | 9/1991 | Kim | 241/19 |

OTHER PUBLICATIONS

"Final Technical Report: Development And Phase I: Proof Of Concept Testing Of Conspray Dynamic Sleeve Piston Coal Feeder", D. O. E. Contract DE–AC21–80MC14603, by Conspray Construction Systems, Inc., Jun. 30, 1982.

"Conspray Dynamic Sleeve Position Coal Feeder: Operational Description And Test Program Results", Presented to American Institute Of Chemical Engineers, by Conspray Construction Systems, Inc, Jun. 7–9, 1982.

*Primary Examiner*—John M. Husar

*Attorney, Agent, or Firm*—Chilton, Alix & Van Kirk

[57] ABSTRACT

A method for feeding a dry pulverized solid material such as coal or limestone into a high pressure combustor is disclosed which employs a high pressure combustor is disclosed which employs a high pressure dry solids pump. The material is first pulverized and transported with air to a separator. The separated solids are temporarily accumulated and fed to one or more dry solids pump which continuously discharge the compact solids at high pressure into a gas mixing chamber. The compact solids are mixed with transport air as a dense phase for transport to the high pressure combustor.

9 Claims, 1 Drawing Sheet

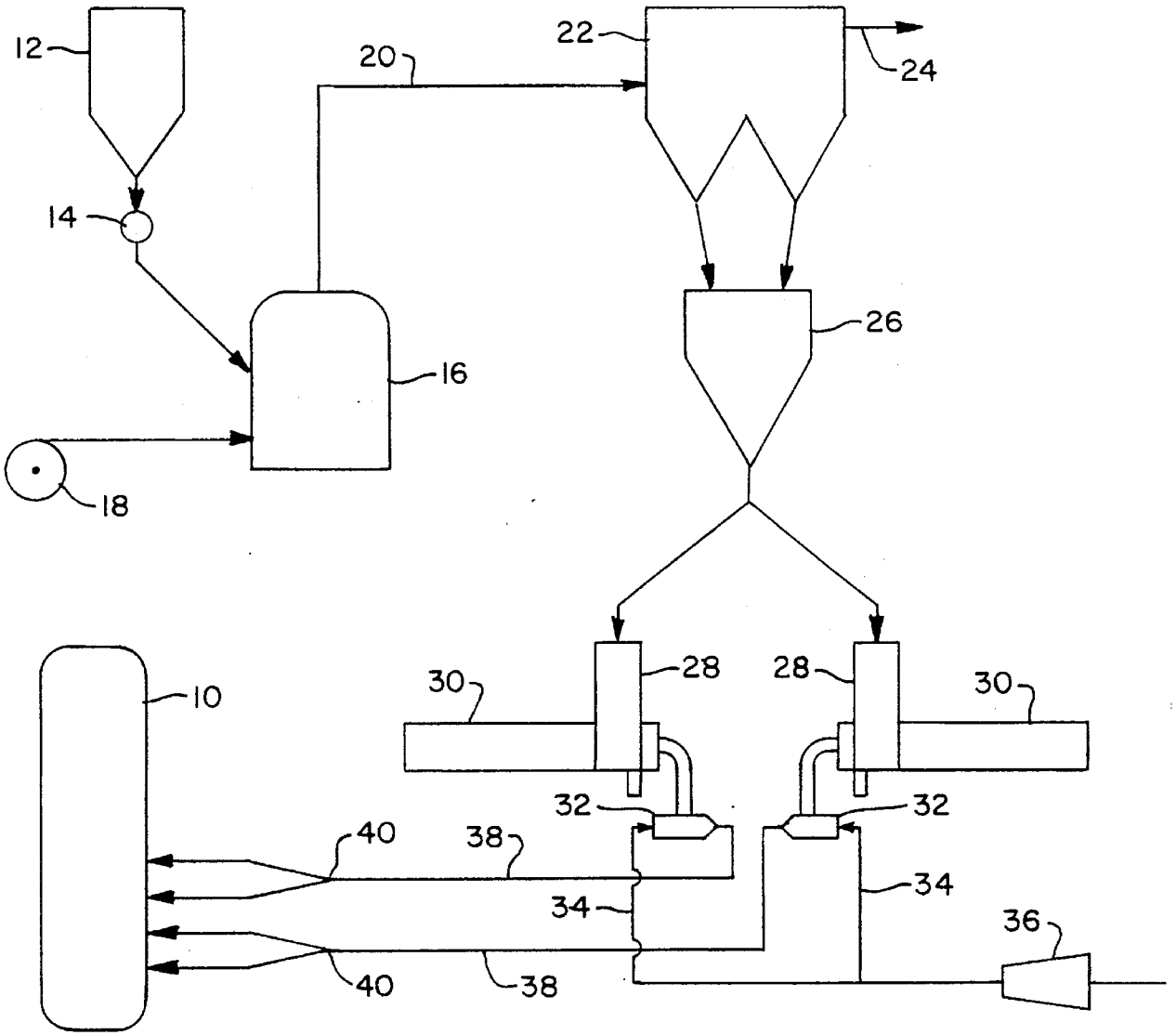
24
22
26
20
16
12
14
18
30
28
32
34
36
38
40
10

DRY SOLIDS PUMP SYSTEM FOR FEEDING A HIGH PRESSURE COMBUSTOR

The present invention relates to a method and system for feeding a dry solids such as fuel or absorbent into a high pressure combustor.

BACKGROUND OF THE INVENTION

High pressure combustion has gained favor because of the significant improvement in the overall thermal efficiency over what can be obtained from boilers operating at or near atmospheric pressure. The main reason for the increased thermal efficiency is the incorporation of a gas turbine in the cycle. High pressure combustion is most often associated with pressurized fluidized-bed combustion or coal gasification operating at pressures 10 to 20 times atmospheric pressure. Another advantage to high pressure combustion is that the equipment is smaller in size for a given energy output.

Fluidized-bed combustion offers versatility for burning a wide variety of fuels including many that are too poor in quality for use in conventional firing systems. Fuels which contain high concentrations of ash, sulfur and nitrogen can be burned efficiently while meeting stringent requirements for the control of stack emissions without the use of flue-gas scrubbers. Although liquid and gaseous fuels can be readily used in a high pressure fluidized-bed combustion system, the fuel is typically coal. It thus becomes apparent that a system must be provided to transport the solid fuel from atmospheric conditions and introduce it into the high pressure combustor. The same problem exists for the introduction of any solid sorbent which may be used, such as limestone or dolomite, for the capture of the sulfur oxides.

There are presently two types of systems in use for feeding solid fuel and/or sorbent material into high pressure combustors. The most common approach with solid fuels is to reduce the solids to fine particulates and then mix them with a liquid, such as oil or water, to form a pumpable slurry. The resulting slurry can then be pressurized and regulated using conventional slurry pumping equipment. The disadvantage is the need to add a liquid. The use of water reduces the efficiency of the combustion process because the water takes energy to vaporize. With oil, a more expensive fuel mixture is being used as opposed to using only coal. The other approach with dry solids is to employ a system of lockhoppers to pressurize the solids and then introduce them at elevated pressure into a high pressure pneumatic conveying system. See, for example, U.S. Pat. No. 4,335,733. Such a system normally does not have a very large turndown capability and requires the use of a considerable quantity of inert pressurizing gas for the lockhoppers.

SUMMARY OF THE INVENTION

The object of the present invention is to provide a supply of pulverized solid material such as coal or limestone at a high pressure for introduction into a high pressure combustor. More particularly, the invention involves pulverizing the solid material, conveying the pulverized solid material in an air stream from the pulverizer and separating the solid from the air stream. A dry solids pump is employed to continuously feed the separated solids at a high pressure into a high pressure dense phase air stream that conveys the solids to multiple points on a high pressure combustor.

BRIEF DESCRIPTION OF THE DRAWING

The drawing is an overall schematic flow diagram of the present invention.

DESCRIPTION OF THE PREFERRED EMBODIMENT

A high pressure combustor is defined as a pressure vessel operating above one atmosphere for the combustion of a fuel. An example would be a pressurized fluidized bed combustor operating at perhaps 10 to 20 bars (10 to 20 atmospheres) either as a steam generator or a coal gasifier. With such pressurized fluidized bed combustors fired with coal, it is necessary to have a high pressure feed of both coal and sorbent material, such as limestone, in order to inject these solids into the high pressure unit.

The invention will be described with reference to the feeding of coal but it is to be understood that it equally applies to feeding sorbent or mixtures of coal and sorbent.

Referring to the drawing, 10 represents a high pressure combustor of any desired type and 12 represents a bunker for the raw coal. Coal is metered by the metering device 14, such as a belt-type gravimetric feeder or an overshot roll feeder, and fed to the coal pulverizer 16. The pulverized coal is classified and dried by an air stream from the blower 18 and pneumatically conveyed through the duct 20. The duct 20 feeds into a gas-solids separator 22 where the pulverized coal is separated from the transport air which is discharged at 24. This gas-solids separator may, for example, be a bank of bag filters or a series of cyclone separators. From the separator 22, the pulverized coal is fed to the solids receiving bin 26 for the temporary accumulation of the dry pulverized coal to provide surge capacity.

From the bin 26, the coal is distributed to the hopper 28 of the dry solids pumps 30. There may be one or more pumps 30 as required to feed the coal to the combustor. Two such pumps are illustrated in the drawings. For example, there may be a separate pump for feeding each elevation of burners in the combustor or a plurality of pumps may be used for each level. The dry solids pumps 30 may be of any type which are capable of receiving a continuous feed of pulverized coal and continuously pumping the coal out into a discharge line at high pressure. The general type of pump which can be used is disclosed in U.S. Pat. No. 4,036,564. This pump is disclosed for use in pumping concrete but it may also be used to pump dry, pulverized solids up to high pressures. This general type of pump is also described for feeding coal in the "Final Technical Report: Development And Phase I: Proof Of Concept Testing Of Conspray Dynamic Sleeve Piston Coal Feeder; D.O.E. Contract DE-AC21-80MCI4603 by Conspray Construction Systems, Inc., Santa Ana, Calif., Jun. 30, 1982," and in "Conspray Dynamic Sleeve Piston Coal Feeder: Operation Description And Test Program results; Presented To: American Institute Of Chemical Engineers, CPE III, Anaheim, Calif., Jun. 7–9, 1982; By: Conspray Construction Systems, Inc., Santa Ana, Calif."

The preferred pump employs a pair of dynamic sleeves which reciprocate through a hopper filled with the dry, pulverized coal. As the sleeves are alternately driven through the hopper 28 of the pump 30, they fill with coal. The open end of the filled sleeve then stops adjacent its respective outlet opening which is sealed with a gate valve, utilizing a flexible annular seal that is pressurized to seal the end of the sleeve as it meets the gate valve. The sleeve is then pressurized with air or inert gas. The gate valve is then opened and the piston is driven through the sleeve to force the coal out through the opening into a gas mixing chamber 32. As the first sleeve is being emptied, the second sleeve is being reciprocated and filled. After the first sleeve has been fully emptied, the piston in the second sleeve is actuated as the first sleeve is being retracted and then filled. This alternate filling and emptying of the sleeves results in a continuous high pressure flow of dry, pulverized coal into the gas mixing chamber 32.

The gas mixing chamber 32 is a space to transition from the pump outlet geometry to the conveying line into which the pulverized coal is injected at a high pressure and into which a high pressure air or other suitable gas stream 34 is injected from the gas compressor 36. The high pressure gas stream entrains the pulverized coal from the gas mixing chamber 32 and pneumatically conveys the coal through the conveying lines 38 and the flow splitters 40 to the burners of the high pressure combustor 10. As illustrated in the drawing, a flow splitter 40 may be used to feed multiple burners. Depending on burner velocity requirements and number of splits, additional compressed gas may be injected at the flow splitters. The output pressure of the gas compressor 36 is sufficiently higher than the pressure in the high pressure combustor to allow the pneumatic conveying. Although the conveying gas if preferably air, other conveying gases could be used, such as an inert gas or a fuel gas as dictated by the combustion process and/or the safety codes.

The high pressure dry solids injection approach of the present invention differs significantly from the slurry approach. It does not require the addition of liquids to facilitate the pumping. This allows for a more efficient combustion process as compared to the case where water is added to the slurry medium because the combustion process does not have to vaporize the moisture. In the case where liquid fuel is used as the slurry medium, the dry solids technique would be more economical in most situations. Furthermore, no complicated slurry preparation equipment is required. As compared to a prior art lockhopper system, the dry solids pumping system has a greater turndown capability, typically 90% as compared to 50% for a lockhopper system. Lockhoppers require openings at their discharge outlets large enough to prevent bridging and plugging. The discharge rate from a lockhopper is dependent on pressure differential between the lockhopper and conveying line, the hopper geometry and therefore, its minimum discharge opening, the amount and the type of fluidization used. There are inherent limitations on such a system for the reliable amount of turndown that is possible. The flow from the dry solids pump is determined primarily by the velocity of the piston in the sleeve. The velocity of the piston can be varied over a great range particularly on the low end where a lockhopper has the most difficulty. Another advantage of the dry solids pump over the lockhopper is that its discharge rate can be varied virtually independently of the flow in the conveying line. Also, the dry solids pumping system uses less pressurizing gas because there is no need to depressurize any components and vent off-gas during the operating cycle.

I claim:

1. A method of feeding a dry solid material into a high pressure combustor comprising the steps of:

a. pulverizing said dry solid material to a desired particle size in a pulverizer;

b. conveying the pulverized dry solid material from said pulverizer in an air stream;

c. separating said pulverized dry solid material from said air stream;

d. feeding said separated pulverized dry solid material to a dry solids pump at atmospheric pressure;

e. pumping dry compact pulverized solid material from said dry solids pump at said high pressure into a gas mixing chamber;

f. mixing said quantity of high pressure dry solid material as a dense phase with a stream of high pressure air in said gas mixing chamber; and g. conveying said dense phase high pressure dry solid material in said high pressure air stream into a high pressure combustor.

2. A method as recited in claim 1 wherein said dry solid material coal.

3. A method as recited in claim 1 wherein said dry solid material is a sorbent material.

4. A method as recited in claim 1 wherein said step (e) of pumping said pulverized solid material comprises continuously pumping dry compact pulverized solid material into said gas mixing chamber.

5. A method as recited in claim 1 wherein said high pressure is in the range of 10 to 20 bars.

6. A method as recited in claim 1 wherein said high pressure combustor is a fluidized bed combustor.

7. A method as recited in claim 1 wherein said high pressure combustor is a coal gasifier.

8. A method as recited in claim 1 wherein said separated pulverized dry solid material is fed to a solids receiving bin for temporary accumulation and feeding to said dry solids pump.

9. A method as recited in claim 1 wherein said steps of pumping and mixing comprises pumping from a plurality of dry solids pumps and mixing in a plurality of gas mixing chambers.

* * * * *